United States Patent [19]

Nojiri

[11] Patent Number: 5,005,670

[45] Date of Patent: Apr. 9, 1991

[54] METHOD AND APPARATUS FOR MOUNTING DATA GATHERING SYSTEM

[75] Inventor: Howard H. Nojiri, Eugene, Oreg.

[73] Assignee: Spectra-Physics, Inc., San Jose, Calif.

[21] Appl. No.: 328,229

[22] Filed: Mar. 24, 1989

[51] Int. Cl.[5] ..... A47F 9/04

[52] U.S. Cl. ..... 186/61; 235/383

[58] Field of Search ..... 186/59-69; 235/383, 462; 364/567

[56] References Cited

U.S. PATENT DOCUMENTS

| | | | |
|---|---|---|---|
| 2,536,961 | 1/1951 | Smith | 186/68 |
| 4,199,053 | 4/1980 | Casteel | 186/69 X |
| 4,392,553 | 7/1983 | Foster | 186/68 X |
| 4,656,344 | 4/1987 | Mergenthaler et al. | 235/462 |
| 4,766,298 | 8/1988 | Meyers | 235/462 |
| 4,794,240 | 12/1988 | Schorr et al. | 235/462 X |

*Primary Examiner*—F. J. Bartuska

*Attorney, Agent, or Firm*—Killworth, Gottman, Hagan & Schaeff

[57] ABSTRACT

A method and apparatus is disclosed for installing a data gathering system in a checkout counter such that it extends slightly above the surface of the counter. The data gathering system defines an entry side and an exit side. Products to be processed by the system are passed from the counter to the system over the entry side of the system, processed and then passed from the system to the counter over the exit side of the system. The counter adjacent the entry side of the system is elevated such that products processed by the system pass along a downwardly stepped path from the elevated portion of the counter down to the system and then from the system down to the counter on the other side of the system. Preferably, counter elevation is performed by a tapered trim strip which is secured across the counter adjacent the entry side of the data processing system.

6 Claims, 5 Drawing Sheets

METHOD AND APPARATUS FOR MOUNTING DATA GATHERING SYSTEM

CROSS REFERENCE TO RELATED APPLICATIONS

The present application is related to the following U.S. Pat. Applications which were filed on even date herewith: Data Gathering System Including Cradle Suspension, Ser. No. 328,178; Spill Control Mounting for Data Gathering System, Ser. No. 328,230; Scale Calibration/Zeroing in Data Gathering System, Ser. No. 328,188; Data Gathering System Housing/Mounting, Ser. No. 328,461; and, Point-of-Sale Data Gathering System, Ser. No. 328,272.

BACKGROUND OF THE INVENTION

The present invention relates generally to data gathering systems for installation in point of sale checkout counters and, more particularly, to a method and apparatus for mounting such data gathering systems to facilitate smooth handling of products which are presented for purchase at the counters by defining a downwardly stepped path for the products as they progress across the data gathering systems.

Supermarket checkout counters commonly include optical scanners mounted therein for optically scanning bar code labels on products to be purchased as the products are moved over scanning windows in the top surfaces of the scanners. The scanners read and convert bar code labels into product identification and pricing information which is used for sales and other merchandising purposes, such as inventory control. The scanners frequently are associated with weighing scales to accommodate products which are sold by weight, for example, produce, and may be combined with weighing scales to form data gathering systems for compact and convenient installation in the checkout counter.

One example of such a data gathering system is disclosed in U.S. Pat. No. 4,656,344, wherein a scale and an optical scanner are integrated into a single unit which fits within the checkout counter. Another improved data gathering system, which is the subject of related patent application entitled "Data Gathering System Including Cradle Suspension", is disclosed herein for illustrating the use of the present invention. Since the present invention is generally applicable to scales, scanners, data gathering systems including scales and/or scanners and the like, the term "data gathering system" will be used herein to generically refer to all such devices.

Many data gathering systems, such as the system disclosed in U.S. Pat. No. 4,656,344, include an aperture in the upper surface of the system for the passage of scanning light beams such that most items to be scanned must be picked up and moved over the aperture to prevent the items from snagging or catching on edges or sides of the aperture. Other data gathering systems, such as the system described herein, include a flat upper surface having a closed or sealed scanning window such that items to be scanned can be slid over the surface of the system across the scanning window. Even in the instance of the apertured surface data gathering systems, some items, particularly large items, can be slid over the surface of the system.

Accordingly, data gathering systems are mounted such that the upper surfaces of the systems are substantially aligned with the upper surfaces of the counters into which they are installed. In this way, many items can be slid from the counter onto the system and then back to the counter. Unfortunately, particularly in the case of data gathering systems including scales which are subject to downward deflection, the relative positioning of the upper surfaces of the counter and the system are such that items tend to snag or catch on either the system or the counter as they are slid across the system. Of course checkout counters can be custom constructed to accommodate the systems and avoid such snags or catches; however, many applications require the data gathering systems to be fitted into existing counters and the cost of new custom counters could preclude installation of the systems.

Thus, there is a need for a method and apparatus for mounting data gathering systems in existing or new standard counters which facilitates smooth handling of products presented for purchase at the counters by defining a downwardly stepped path for the products as they are slid across the data gathering systems.

SUMMARY OF THE INVENTION

This need is met by the method and apparatus of the present invention wherein a data gathering system is installed in a checkout counter such that it extends slightly above the upper surface of the counter even considering potential downward deflection of the system due to products to be processed being placed on the system. The data gathering system defines an entry side and an exit side such that products to be processed by the system are passed from the counter to the system over the entry side of the system. Once processed, the products are then passed from the system to the counter over the exit side of the system. In accordance with the present invention, the counter adjacent the entry side of the system is elevated such that products to be processed by the system pass along a downwardly stepped path from the elevated portion of the counter down to the system and then from the system down to the counter on the other side of the system. Preferably, counter elevation is performed by a tapered trim strip which is secured to the counter adjacent the entry side of the data gathering system.

In accordance with one aspect of the present invention, a method of mounting a data gathering system within a checkout counter to facilitate smooth handling of products which are presented at the counter for purchase comprises the steps of: supporting the data gathering system within the counter such that an upper surface of the data gathering system is substantially parallel with an upper surface of the counter and extends thereabove by a first defined distance, the data gathering system defining an entry side across which products are passed to access the data gathering system and an exit side across which products are passed after having been processed by the data gathering system; and, elevating the counter adjacent the entry side of the data gathering system by a second defined distance greater than the first defined distance whereby products to be processed by the data gathering system encounter a downwardly stepped path as they are moved from the counter preceding the data gathering system to the counter succeeding the data gathering system and can therefore be slid across the system substantially without being snagged or caught thereon.

The step of elevating the counter adjacent the data gathering system is preferably performed by securing a tapered trim strip across the counter adjacent the entry side of the data gathering system. The trim strip tapers from a height corresponding to the second defined distance adjacent the entry side of the data gathering system to an insignificant height at a third defined distance along the counter preceding the data gathering system. The second defined distance may be as little as approximately 0.040–0.080 inches.

In accordance with another aspect of the present invention, apparatus for mounting a data gathering system inserted into a checkout counter to facilitate smooth handling of products which are presented at the checkout counter for purchase comprises support means for suspending the data gathering system within the checkout counter. The system is suspended such that its upper surface is substantially parallel with an upper surface of the counter and extends thereabove by a first defined distance. The data gathering system defines an entry side across which products are passed to access the data gathering system and an exit side across which products are passed after having been processed by the data gathering system. Finally, trim means are secured to the counter for elevating the counter adjacent the entry side of the data gathering system by a second defined distance greater than the first defined distance whereby products to be processed by the data gathering system encounter a downwardly stepped path as they are moved from the counter preceding the data gathering system to the counter succeeding the data gathering system and can therefore be slid across the data gathering system substantially without being snagged or caught thereon.

The trim means preferably comprises a tapered trim strip secured across the checkout counter adjacent the entry side of the data gathering system. The trim strip tapers from a height corresponding to the second defined distance adjacent the entry side of the data gathering system to an insignificant height at a third defined distance along the counter preceding the data gathering system to slightly elevate the upper surface of the counter above the upper surface of the data gathering system along the entry side of the data gathering system. The second defined distance may be as little as approximately 0.040–0.080 inches.

It is thus an object of the present invention to provide an improved method and apparatus for mounting a data gathering system such that products to be processed by the system are smoothly handled along a downwardly stepped path; to provide an improved method and apparatus for mounting a data gathering system such that products to be processed by the system are smoothly handled along a downwardly stepped path by mounting the system to extend slightly above the counter and elevating the edge of the counter adjacent an entry side of the system such that the counter extends above the system along the entry side; and, to provide an improved method and apparatus for mounting a data gathering system such that products to be processed by the system are smoothly handled along a downwardly stepped path by mounting the system to extend slightly above the counter and securing a tapered trim strip to the edge of the counter adjacent an entry side of the system to elevate that edge of the counter to extend above the system along its entry side.

Other objects and advantages of the invention will be apparent from the following description, the accompanying drawings and the appended claims.

DETAILED DESCRIPTION OF THE INVENTION

While generally applicable to scanners, data gathering systems including scanners and the like, the mounting method and apparatus of the present invention is particularly applicable to a combined two part data gathering system which comprises a scale mounted within the counter and an optical scanner rested upon a load receiving plate or subplatter of the scale such that bar coded labels on products can be read by the optical scanner and the weight of such products can also be determined by placement on the optical scanner. Accordingly, the mounting method and apparatus will be described with reference to such a combined two part system.

Reference is now made to the drawings which show a data gathering system 100 in accordance with the present invention which is designed for use in a point of sale checkout counter 102. The data gathering system 100 is designed to be fitted entirely within the counter 102 and is structured as two separate units which can be independently manufactured, tested, packaged and shipped and also individually handled and installed. By structuring the system as two separate units, it initially can be easily installed in the counter 102 and thereafter easily removed and reinstalled for system maintenance and repair. Further, the scanning operation can be more easily and accurately performed since scanning light beams pass directly from the scanner as opposed to passage through secondary windows and/or apertures as in prior art systems wherein a scale platter is required above the top of the scanner. The data gathering system 100 conveniently provides for both reading bar-coded labels secured to products to be purchased and also weighing products which are placed upon the upper surface of the system.

Figure 3:
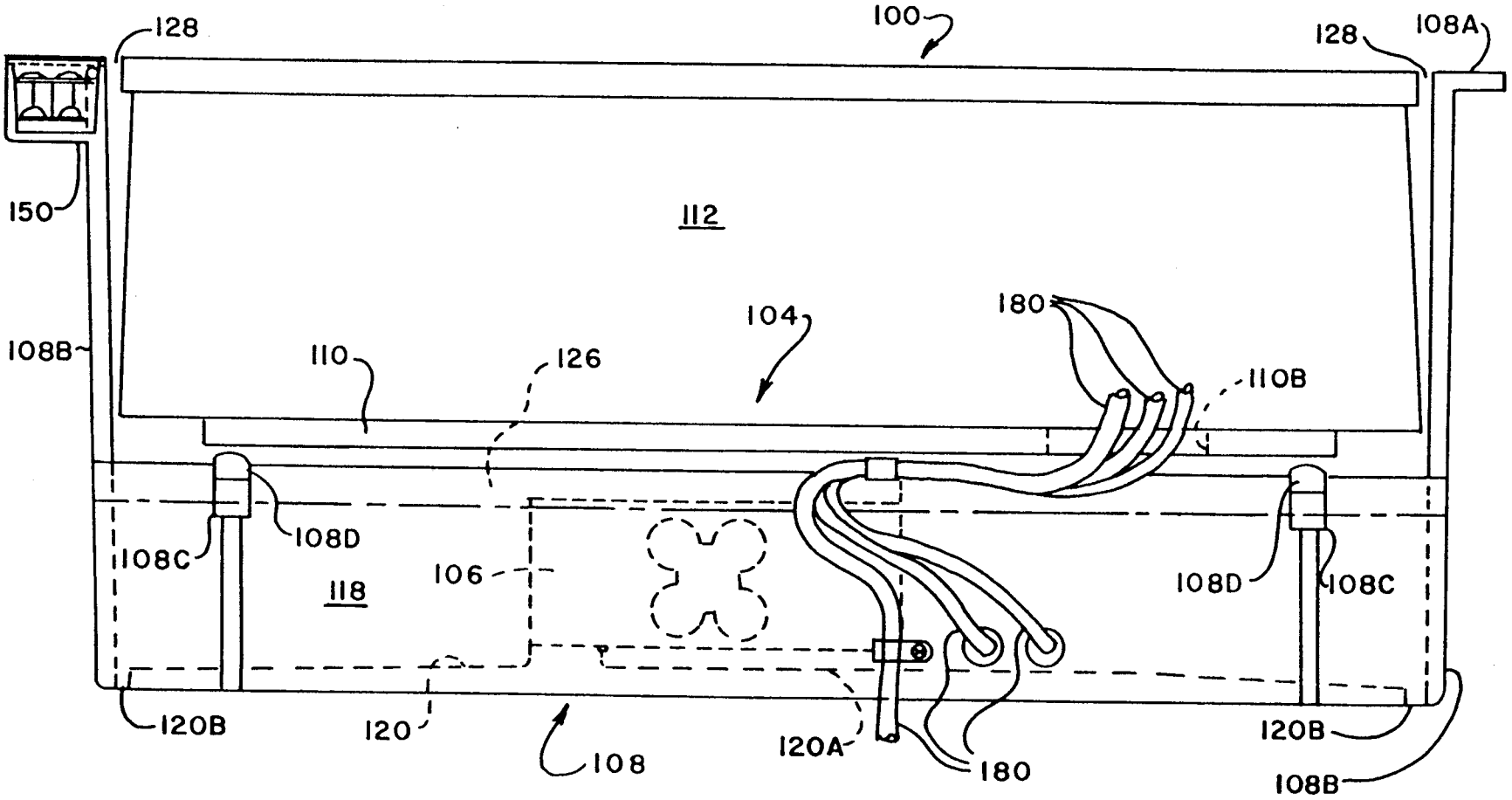
Figure 4:
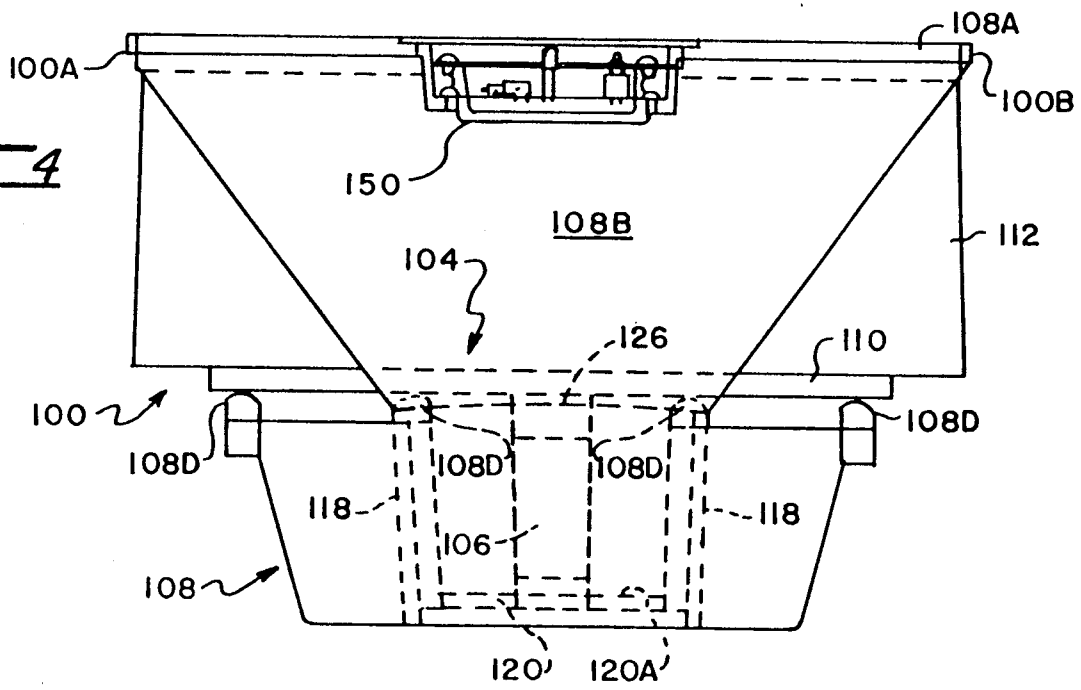

The data gathering system 100 comprises scale means, taking the form of a load cell scale 104 in the illustrated embodiment, which is supported within the checkout counter 102 by support means and provides for determining weights of products presented to the data gathering system 100. The scale 104 comprises a load cell 106 secured at one end 106A to the support means which comprises a support cradle 108 in the preferred embodiment, and to a scale load receiving plate or subplatter 110 at its opposite end 106B. The subplatter 110 is located below the upper surface 102A of the checkout counter 102 as best shown in FIGS. 3 and 4.

Optical scanning means comprising a self-contained optical scanner 112 is rested upon the scale subplatter 110 for reading coded labels, such as bar-coded labels, on products presented for purchase at the checkout counter 102. The optical scanner 112 has an upper surface 112A including an optical scanning window 112B through which scanning light beams pass. The optical scanning window 112B is flush with the remainder of the upper surface 112A such that the window 112B and upper surface 112A are easy to clean. The remainder of the upper surface 112A defines a weighing area adjacent to the window 112B which receives the majority of items to be weighed such that debris from those items will not fall on the window 112B tending to keep it clean.

The optical scanner 112 is sized and vertically positioned such that its upper surface 112A is substantially aligned with the upper surface 102A of the checkout counter 102 when the optical scanner 112 is rested upon the scale weighing platter 110. The weight of the optical scanner 112 and associated cabling is, like that of the subplatter 110, zeroed out in establishing the scale zero reading during calibration or treated as a tare weight for the scale 104. Thus, the upper surface 112A of the optical scanner 112 serves as the scale weighing platter for receiving products to be weighed and only the product weights are included in the weight readings.

The scale subplatter 110 and scanner 112 include scanner locator means comprising two raised circular bosses 110A on the subplatter 110 which are received by corresponding indentations (not shown) formed into the bottom of the optical scanner 112 in the illustrated embodiment. The scanner locator means provide for positioning and horizontally stabilizing the optical scanner 112 on the scale subplatter 110 for assembly and operation of the data gathering system 100. Alternately, bosses or pins could be formed on the scanner 112 with matching identations or holes on the subplatter 110, or combinations of bosses and matching indentations could be formed on both the scanner 112 and the subplatter 110. Of course, differently shaped bosses or different locating means can be provided as will be apparent to those skilled in the art.

Figure 1:
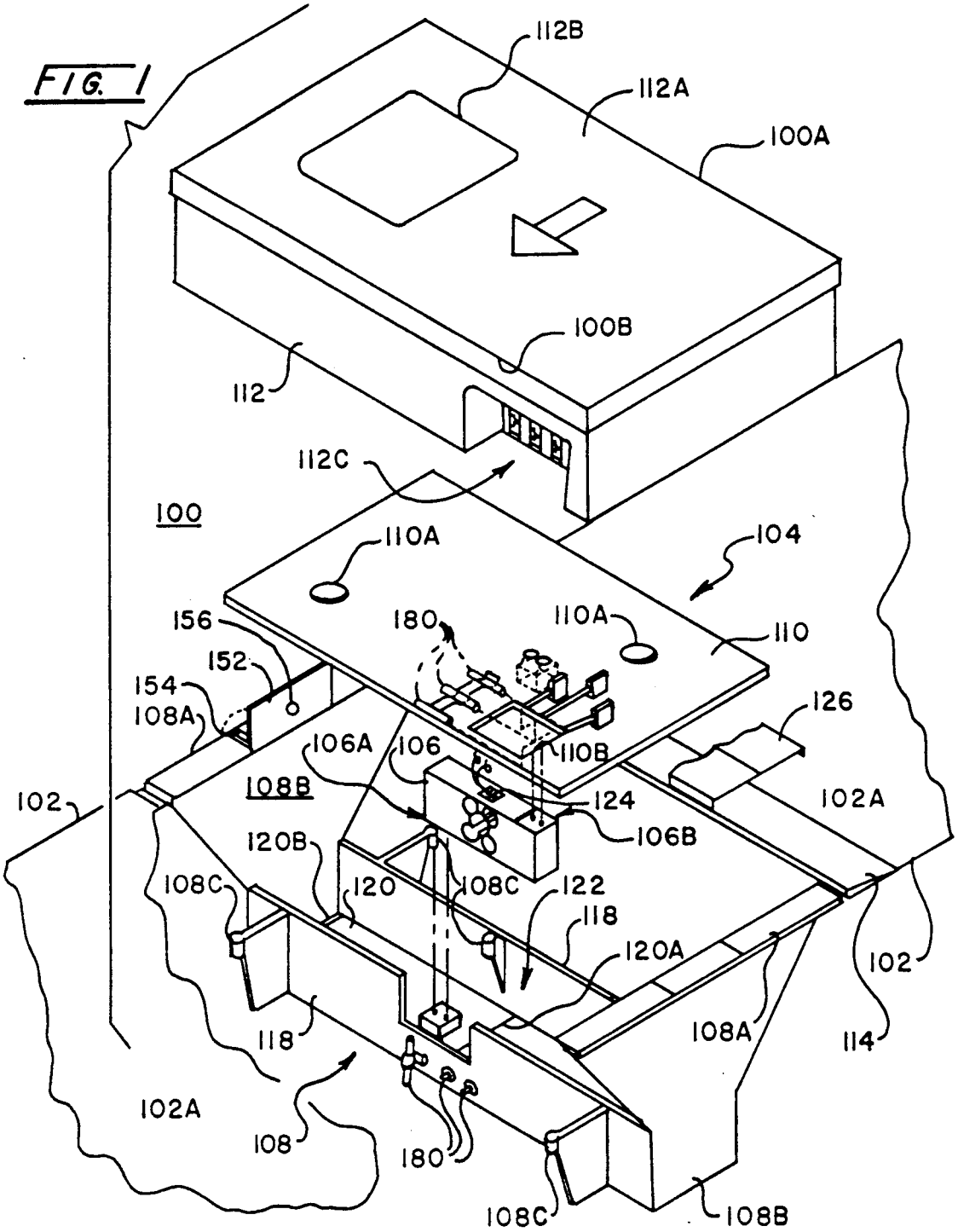
FIG. 1 is an exploded perspective view of a data gathering system for use in a checkout counter which is mounted in accordance with the present invention.
Figure 5:
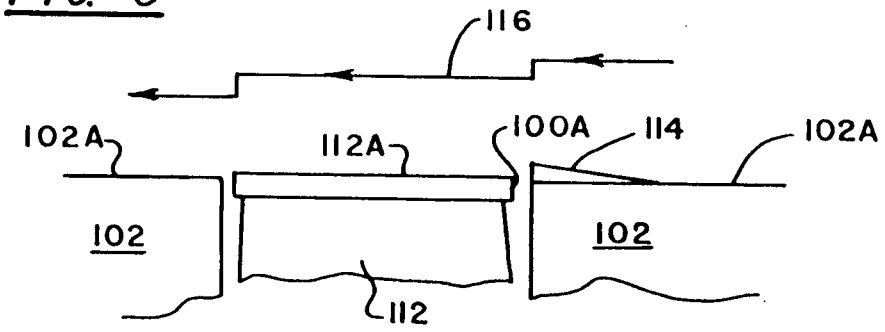
FIG. 5 is a schematic side view of the upper surface of a checkout counter including the data gathering systems of FIG. 1 and showing a trim strip for defining a preferred product flow path in accordance with the present invention.

Preferably, the data gathering system 100 is positioned within the checkout counter 102 such that the upper surface 112A of the optical scanner 112 is slightly above the upper surface 102A of the counter 102 as best shown in FIGS. 1 and 5. This positioning of the data gathering system 100 within the counter 102 combined with a tapered trim strip 114 defines a downwardly stepped path illustrated by the arrow 116 shown in FIG. 5 for products to be processed by the system. The tapered trim strip 114 is secured across the checkout counter 102 adjacent the entry side 100A of the data gathering system 100 to slightly elevate the upper surface 102A of the counter 102 above the upper surface 112A of the system.

The trim strip 114 is shown as having exaggerated thickness in FIG. 5; however, it can be quite thin, as thin as 0.040–0.080 inch depending upon the stiffness of the scale 104, and yet provide smooth passage of products across the data gathering system 100. The downwardly stepped path for products processed by the system is important since the smooth upper surface 112A of the scanner 112 permits products to be slid thereacross by a sales clerk using the data gathering system 100. If a downwardly stepped path is not provided, products may catch at the entry side 100A and potentially at the exit side 100B of the system inconveniencing the sales clerk and substantially reducing this attractive feature of the system. It should be apparent that the disclosed downwardly stepped product path is equally applicable to a data gathering system comprising a scale which is not combined with a weighing scale.

The support means or support cradle 108 is adapted to be hung from the checkout counter 102 by means of support flanges 108A which extend from end plates 108B of the support cradle 108 to freely suspend the system 100 within the counter 102. The end plates 108B are separated from one another by a distance which is preferably substantially equal to the length of the scanner 112 plus ¼ inch such that with the scanner 112 centered therebetween, a ⅛ inch air gap is maintained at each end of the scanner. Similar sizing/spacing is defined at the entry and exit sides 100A, 100B of the system, see FIGS. 2 and 3.

Such spacing is important since the upper surface of the system defining the scale weighing platter must be free to deflect vertically without contact with the counter to ensure accurate weights. In the prior art, problems have been encountered due to irregularities or insufficient length or width of the counter openings which can result in improper installation and weights. Problems can also be created in the prior art due to lateral movement of the scale caused by placing or sliding products over the scale platter. Such problems are substantially eliminated by the present system. It should be apparent that the counter 102 can be adapted to support the data gathering system 100 from the support flanges 108A such that the system can be precisely located relative to the counter 102 with convenient adjustment, if necessary, being provided by shims or otherwise. The data gathering system 100 may be maintained in position by interengagement of the support flanges 108A with the counter 102 or a variety of fastener devices can be employed if desired as will be apparent to those skilled in the art.

Figure 2:
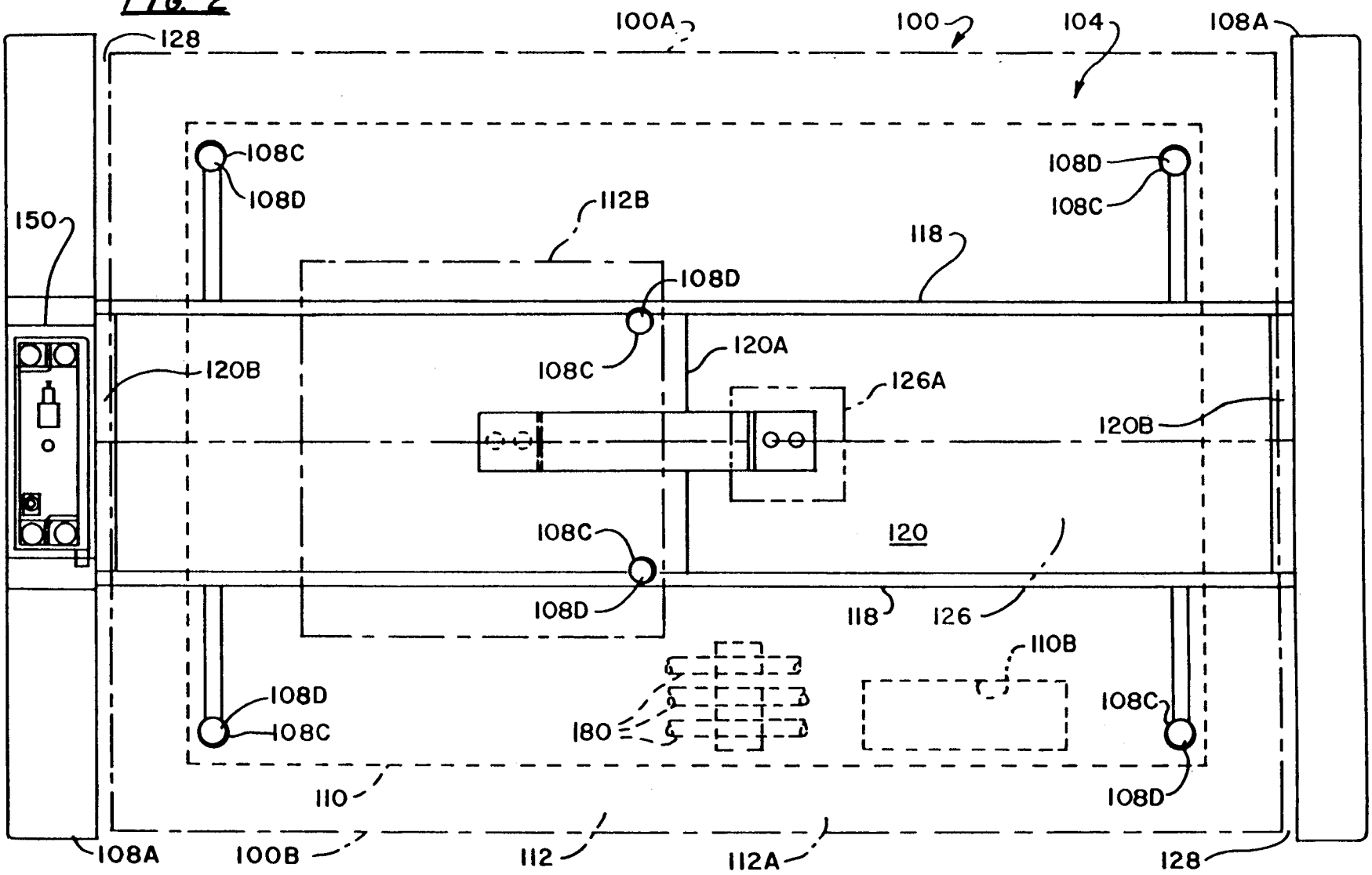
FIGS. 2–4 are top, side and end views, respectively, of the data gathering system of FIG. 1.

The support cradle 108 comprises at least two scale subplatter stop members 108C, six stop members 108C being included in the illustrated embodiment as best shown in FIGS. 1 and 2, positioned to engage the scale subplatter 110 at the maximum allowable extent of its travel to thereby prevent potentially damaging overloading of the load cell 106. Preferably, stop pads 108D made of hardened tool steel are formed at the upper surfaces of the stop members 108C as shown in FIGS. 2–4.

The support cradle 108 comprises generally vertical side walls 118 and a bottom wall 120 which define a channel 122 extending laterally across the checkout counter 102 for receiving and protecting the load cell 106 and electrical circuitry (not shown) which is connected to and operable with one or more force transducers, such as strain gauges 124, see FIG. 1, of the load cell 106 in accordance with well known weighing scale technology. The bottom wall 120 is peaked near its center 120A such that it gradually tapers downwardly toward the end plates 108B of the support cradle 108 adjacent which the bottom wall 120 terminates in open slots 120B. A crowned channel cover 126, shown in FIGS. 1–4, includes an opening 126A through which the load cell 106 is connected to the scale subplatter 110, see FIG. 2.

This support arrangement or mounting for the data gathering system 100 is preferred since it provides improved spill control over the prior art. In particular, any spilled liquids which flow over the entry side 100A or exit side 100B of the system will flow harmlessly down the sides of the optical scanner 112 to the floor beneath the system where it can be periodically or immediately attended to through access panels (not shown) in the counter 102. Spilled liquids which flow down the ends of the system are limited to some extent by the narrow slots 128 between the optical scanner 112 and the support flanges 108A/end plates 108B of the support cradle 108, see FIGS. 2 and 3. Further, the majority of such liquid will also flow harmlessly to the floor beneath the system due to the narrowness of the width of the channel 122 which is approximately one third of the width of the data gathering system 100. The remaining small portion of spilled liquid which passes through the narrow slots 128 will initially engage the crowned channel cover 126 and be diverted to the sides of the channel 122 and once again to the floor beneath the system.

Any spilled liquid which does manage to seep past the channel cover 126 will flow down the interior surfaces of the end plates 108B and/or be diverted by the tapered bottom wall 120 to pass to the floor beneath the system through the slots 120B. Spilled liquids are thus eliminated from the data gathering system 100 by paths which do not tend to interfere with the movement and hence the operation of the scale 104 of the system. While liquids, particularly thick liquids, may tend to accumulate on the optical scanner walls and change the zero setting of the scale 104, this creates no problem since the scale 104 can be conveniently calibrated and/or automatically or manually zeroed without removal of the system 100 from the counter 102 as will now be described.

Figure 7:
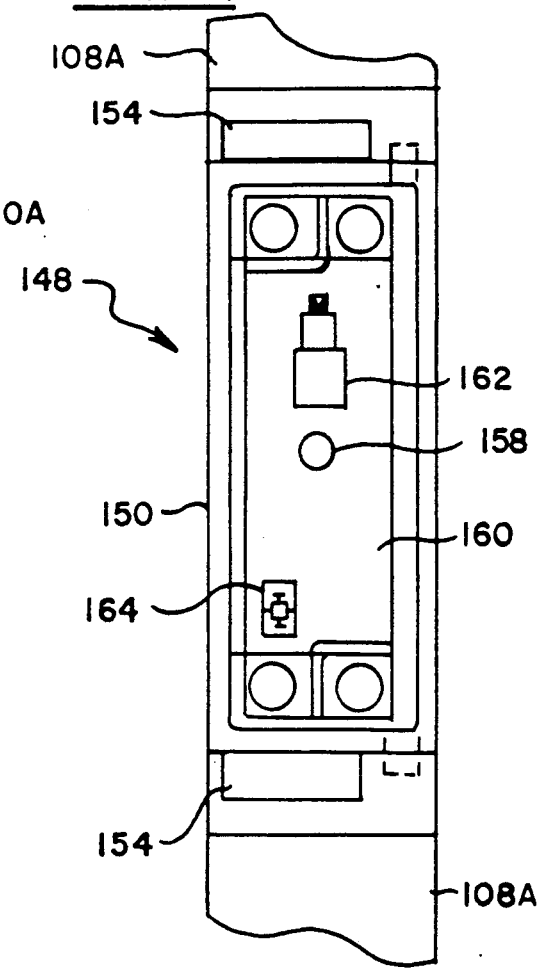
Figure 8:
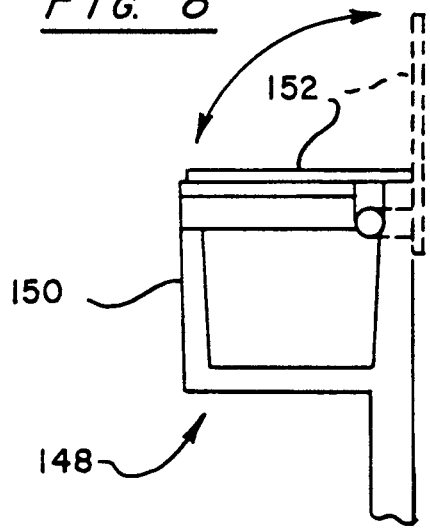

The data gathering system 100 includes scale adjusting means comprising a scale calibrating/zeroing system 148 which is integrated into one of the support flanges 108A. The calibrating/zeroing system 148 is enclosed in a housing 150 as generally shown in FIGS. 1–4 and best shown in FIGS. 6–8 wherein various elements of the system are not shown in all the drawing figures for ease of description and illustration. The housing 150 is covered by a hingedly mounted door 152 formed of a ferromagnetic material and maintained in its closed position by magnets 154 embedded within the support flange 108A and includes a window 156 through which a light source such as a light emitting diode (LED) 158 visibly signals a sales clerk using the data gathering system 100 or other personnel servicing the system. Other housing closures such as snap fitting latches and the like will be apparent to those skilled in the art for use in the present invention.

Figure 6:
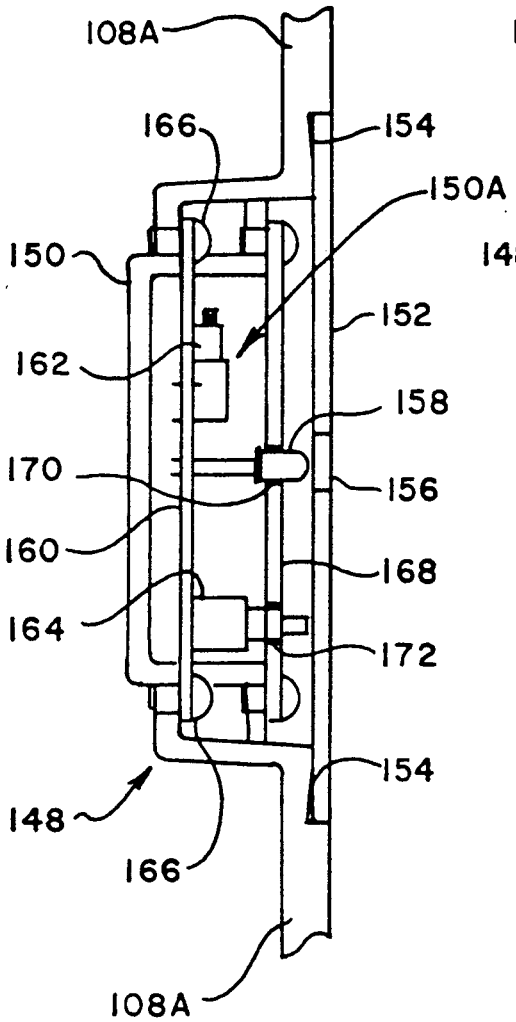
FIGS. 6–8 illustrate a preferred calibration and zeroing arrangement for the scale of the data gathering system.

Mounted within a chamber 150A, see FIG. 6, of the housing 150 is a circuit board 160 to which is mounted a scale calibration switch 162, the LED 158 and a scale zeroing switch 164. The circuit board 160 is secured within the chamber 150A of the housing 150 by screws 166 or other appropriate fastening devices. A cover panel 168, see FIG. 6, is secured and preferably sealed in the upper part of the housing 150 to form an upper wall of the chamber 150A. The cover panel 168 includes apertures 170 and 172 through which the LED 158 and the zeroing switch 164 protrude, respectively. A lighted switch could be used, if desired, to replace the LED 158 and the zeroing switch 164 for a potentially simplified user interface. In any event, the panel 168 thus permits access to the zeroing switch 164 if the door 152 is opened by a sales clerk or other authorized person to permit convenient zeroing or rezeroing of the scale 104; however, the panel 168 prevents access to the calibration switch 162 which should only be operated by service personnel on a periodic basis. After calibration, the panel 168 would be sealed in accordance with requirements of local weights and measures.

In accordance with the calibrating/zeroing system 148 of the data gathering system 100, if the scale 104 indicates a weight other than zero when nothing is present on the upper surface 112A of the optical scanner 112, the operator can zero the scale 104 by activating the scale zeroing switch 164 after opening the door 152. Zero drifts may be caused, for example, by the accumulation of debris on the extended optical-scanner/weighing-platter combination. Also, to ensure accurate weighing operations, the scale 104 is periodically calibrated or recalibrated by authorized service personnel. However, in this system, as opposed to the prior art, the service person merely has to open the door 152, remove the weights and measures seal and the cover panel 168, and depress the calibration switch 162 to initiate the calibration operation.

Accordingly, the data gathering system 100 does not have to be removed from the counter 102 for such standard maintenance operations. The LED 158 is used to signal the operator that service is required and to assist in performing the service which is required. For example, the LED 158 may be lighted to advise the operator that the scale 104 is zeroed and extinguished if the scale 104 drifts out of zero. For calibration, the lighting of the LED 158 can be controlled to advise the service person that steps of a calibration operation have been properly performed.

As an example of a calibration routine for a scale having a 30 pound (15 kg) capacity, a precision weight of 20 pounds (10 kg) and zero weight may be used. Initially, the calibration switch 162 is depressed to start the calibration routine. The LED 158 will begin to blink indicating the calibrate mode. A service person ensures that no weight is present on the optical-scanner/weight-platter and then depresses the zeroing switch 164. Once this step is successfully completed, the LED 158 is lighted for approximately 5 seconds and then begins blinking again to signal the service person to place the 20 pound (10 kg) weight on the center of the optical-scanner/weighing-platter and press the zeroing switch 164. The LED 158 will then extinguish for approximately 5 seconds and then light steadily when calibration is completed. From these two known data points, the scale 104 can generate accurate weight signals for products placed on the upper surface 112A of the optical scanner 112. Of course, alternate calibration and zeroing techniques can be used in the calibrating/zeroing system disclosed.

To prevent interference with operation of the scale 104, cables for conducting electrical signals and power between the optical scanner 112 and the scale 104 of the data gathering system 100 are formed and secured to the scale 104 during its manufacture. More particularly, cables 180 are sized such that they extend between and are secured to the scale subplatter 110 and one of the side walls 118 of the channel 122 such that the cables 180 permit free deflection of the load cell 106 but do not affect such deflection, see FIGS. 1–3. By thus sizing and routing the cables 180 such that they do not affect the deflection of the load cell 106, the weight of the cables 180 can be compensated during calibration of the scale 104. This cabling arrangement is important since cables to the optical scanner 112 must be routed through the scale subplatter 110 via an opening 110B therethrough. The cables 180 include sufficient slack to permit quick and easy installation and removal of the scanner 112. The cables 180 are then routed up to a vestibule 112C on the scanner 112 and connected to the appropriate connectors therein.

Having thus described the data gathering system of the present invention in detail and by reference to preferred embodiments thereof, it will be apparent that modifications and variations are possible without departing from the scope of the invention defined in the appended claims.

What is claimed is:

1. A method of mounting a data gathering system within a checkout counter to facilitate smooth handling of products which are presented at said counter for purchase, said method comprising the steps of:

supporting said data gathering system within said counter such that an upper surface of said data gathering system is substantially parallel with an upper surface of said counter and extends thereabove by a first defined distance, said data gathering system defining an entry side across which products are passed to access said data gathering system and an exit side across which products are passed after having been processed by said data gathering system; and elevating a portion of said counter adjacent the entry side of said data gathering system by a second defined distance greater than said first defined distance whereby products to be processed by said data gathering system are raised from said upper surface of said counter over the elevated portion of said counter and then encounter a downwardly stepped path as they are moved from the elevated portion of said counter preceding said data gathering system downwardly to the upper surface of said data gathering system and downwardly therefrom to said counter succeeding said data gathering system such that said products can be slid across the system substantially without being snagged or caught thereon.

2. A method of mounting a data gathering system within a checkout counter as claimed in claim 1 wherein the step of elevating said counter adjacent said data gathering system is performed by securing a tapered trim strip across said counter adjacent the entry side of said data gathering system, said trim strip tapering from a height corresponding to said second defined distance adjacent the entry side of said data gathering system to an insignificant height at a third defined distance along the counter preceding said data gathering system.

3. A method of mounting a data gathering system within a checkout counter as claimed in claim 2 wherein said second defined distance is approximately 0.040–0.080 inches.

4. Mounting apparatus for a data gathering system inserted into a checkout counter, said apparatus facilitating smooth handling of products which are presented at said checkout counter for purchase and comprising:

support means for suspending said data gathering system within said checkout counter such that an upper surface of said data gathering system is substantially parallel with an upper surface of said counter and extends thereabove by a first defined distance, said data gathering system defining an entry side across which products are passed to access said data gathering system and an exit side across which products are passed after having been processed by said data gathering system; and trim means secured to said counter for elevating said counter adjacent the entry side of said data gathering system by a second defined distance greater than said first defined distance whereby products to be processed by said data gathering system are raised from said upper surface over said trim means and then encounter a downwardly stepped path as they are moved from the portion of said counter elevated by said trim means and preceding said data gathering system downward to the upper surface of said data gathering system and downward therefrom to the upper surface of said counter succeeding said data gathering system such that said products can be slid across the data gathering system substantially without being snagged or caught thereon.

5. Mounting apparatus for a data gathering system inserted into a checkout counter as claimed in claim 4 wherein said trim means comprises a tapered trim strip secured across said checkout counter adjacent the entry side of said data gathering system, said trim strip tapering from a height corresponding to said second defined distance adjacent the entry side of said data gathering system to an insignificant height at a third defined distance along the counter preceding said data gathering system to slightly elevate the upper surface of said counter above the upper surface of said data gathering system.

6. Mounting apparatus for a data gathering system inserted into a checkout counter as claimed in claim 5 wherein said second defined distance is approximately 0.040–0.080 inches.

* * * * *